US008562105B2

(12) United States Patent
Wang

(10) Patent No.: US 8,562,105 B2
(45) Date of Patent: Oct. 22, 2013

(54) FIXING STRUCTURE FOR PRINT HEAD CARRIAGE ROD AND FIXING METHOD THEREOF

(75) Inventor: Chih-Hwa Wang, Taipei (TW)

(73) Assignees: Cal-Comp Electronics & Communications Company Limited, New Taipei (TW); Kinpo Electronics, Inc., New Taipei (TW)

( * ) Notice: Subject to any disclaimer, the term of this patent is extended or adjusted under 35 U.S.C. 154(b) by 277 days.

(21) Appl. No.: 12/801,111

(22) Filed: May 24, 2010

(65) Prior Publication Data

US 2011/0249054 A1 Oct. 13, 2011

(30) Foreign Application Priority Data

Apr. 12, 2010 (TW) ..... 99111333 A

(51) Int. Cl.
*B41J 2/015* (2006.01)

(52) U.S. Cl.
USPC ..... 347/37; 400/352

(58) Field of Classification Search
CPC ..... B41J 2/1623; B41J 29/02
USPC ..... 347/37, 20, 73, 108; 400/352, 354, 691
See application file for complete search history.

(56) References Cited

U.S. PATENT DOCUMENTS 4,089,569 A * 5/1978 Rempel ..... 384/536
2005/0001875 A1* 1/2005 Ueda et al. ..... 347/37

FOREIGN PATENT DOCUMENTS

JP 2004268338 A * 9/2004 ..... B41J 19/20
TW M258522 3/2005
TW I302123 10/2008

OTHER PUBLICATIONS

"Office Action of Taiwan counterpart application" issued on May 25, 2012, p. 1-p. 6.

* cited by examiner

*Primary Examiner* — Julian Huffman
*Assistant Examiner* — Sharon A Polk
(74) *Attorney, Agent, or Firm* — Jianq Chyun IP Office

(57) ABSTRACT

A fixing structure for print head carriage rod and a fixing method thereof. The fixing structure is simplified and is able to minimize the flexure of the print head carriage rod. The fixing structure includes a frame body disposed in a printing machine, and a carriage rod mounted on the frame body for a print head carriage to reciprocally travel on the carriage rod for printing operation. The frame body has sidewalls and support sections formed on the sidewalls for supporting two ends of the carriage rod. The fixing structure further includes retainers for securing the carriage rod to the frame body. The retainers are positioned on two sides of the support sections of the sidewalls to together with the support sections prevent the carriage rod from being flexed so as to avoid deterioration of printing quality.

13 Claims, 4 Drawing Sheets

FIXING STRUCTURE FOR PRINT HEAD CARRIAGE ROD AND FIXING METHOD THEREOF

BACKGROUND OF THE INVENTION

1. Field of the Invention

The present invention relates generally to a fixing structure for a carriage rod and a fixing method thereof, and more particularly to a fixing structure for a carriage rod on which an ink cartridge carriage of a printing machine is supported to reciprocally travel along the carriage rod.

2. Description of the Related Art

It is well known that a paper can be printed with a printing machine such as an inkjet printer. The inkjet printer has an ink cartridge having a print head. The ink cartridge is carried by an ink cartridge carriage to reciprocally move in a direction normal to a paper delivery direction. The ink cartridge carriage is positioned above the surface of a paper that passes through a printing section by a set height, whereby the print head can jet the ink onto the paper to form characters or pictures.

In general, the ink cartridge carriage is supported on a carriage rod to reciprocally travel along the carriage rod for printing operation. The carriage rod has two ends retained on a frame body of the printing machine. In a conventional fixing structure for the carriage rod, the frame body has two sidewalls each of which is provided with a cavity and a clamping mechanism. Two ends of the carriage rod are respectively inserted into the cavities and retained by the clamping mechanisms. As well known by those skilled in this field, the frame body with the cavities and the clamping mechanisms has relatively complicated structures and is manufactured at higher cost.

In another conventional fixing structure for the carriage rod, the two ends of the carriage rod are directly secured to the frame body by means of retainers such as rivets, screws or the like. The sidewalls of the frame body support the carriage rod in cooperation with the retainers. Before the retainers are tightened to lock the two ends of the carriage rod to the frame body, the retainers will not exert a stress onto the carriage rod. Under such circumstance, the carriage rod will not be strained. However, when the retainers are tightened with a torque to secure the two ends of the carriage rod to the frame body, a screw fasten force is applied to the two ends of the carriage rod. At this time, a middle section of the carriage rod will be flexed to change the set height of the ink cartridge carriage reciprocally traveling along the carriage rod through the printing section. This will affect the printing quality. FIGS. 1, 2 and 3 respectively are a force diagram, a shear diagram and a bending moment diagram of a conventional carriage rod, which is tightened to a frame body by means of the retainers and the cooperative sidewalls of the frame body. FIG. 3 shows that the flexed section of the carriage rod is right above the printing section. It can be known from the above that it is not optimal to directly secure the two ends of the carriage rod to the frame body by means of the retainers.

In another conventional fixing structure for the carriage rod, the frame body is formed with slots and provided with slightly resilient cantilevers between the slots. When the two ends of the carriage rod are respectively locked to the cantilevers of the frame body by means of the retainers, the cantilevers are able to partially absorb the deformation of the carriage rod caused by the torque of the retainers. However, with the slots and the cantilevers, the structural strength of the frame body is weakened. As a result, the carriage rod tends to vibrate when the ink cartridge carriage reciprocally travels along the carriage rod in printing operation. Moreover, in some cases, for example, during transfer, delivery or maintenance of the printing machine, the carriage rod is likely to be displaced or damaged due to collision caused by negligence.

SUMMARY OF THE INVENTION

It is therefore a primary object of the present invention to provide a fixing structure for print head carriage rod. The fixing structure is simplified and is able to minimize the flexure of the print head carriage rod. The fixing structure includes a frame body disposed in a printing machine, and a carriage rod mounted on the frame body for a print head carriage to reciprocally travel on the carriage rod for printing operation. The frame body has sidewalls and support sections formed on the sidewalls for supporting two ends of the carriage rod. The fixing structure further includes retainers for securing the carriage rod to the frame body. The retainers are positioned on two sides of the support sections of the sidewalls to together with the support sections prevent the carriage rod from being flexed so as to avoid deterioration of printing quality.

It is a further object of the present invention to provide a fixing structure for print head carriage rod. The fixing structure includes a frame body and a carriage rod assembled therewith. The carriage rod has two ends each of which is secured to the frame body by means of a retainer. The frame body is disposed in a printing machine having a printing section. The frame body has two pairs of support sections formed on sidewalls of the frame body for supporting the two ends of the carriage rod respectively. Each pair of support sections is positioned on two sides of the retainer. The retainers and the support sections together prevent the carriage rod from being flexed.

It is still a further object of the present invention to provide a fixing method for print head carriage rod. The fixing method includes steps of: (a) disposing a first retainer at each of two ends of a carriage rod, the first retainer being arranged on a left side or a right side of the support section of a sidewall of a frame body; and (b) disposing a second retainer at each of the two ends of the carriage rod, the second retainer being arranged on the right side or the left side of the support section of the sidewall opposite to the first retainer. The first and second retainers are respectively arranged on two sides of the support section. A distance between the first retainer and the support section is equal to a distance between the second retainer and the support section.

The present invention can be best understood through the following description and accompanying drawings, wherein:

DETAILED DESCRIPTION OF THE PREFERRED EMBODIMENTS

Figure 4:
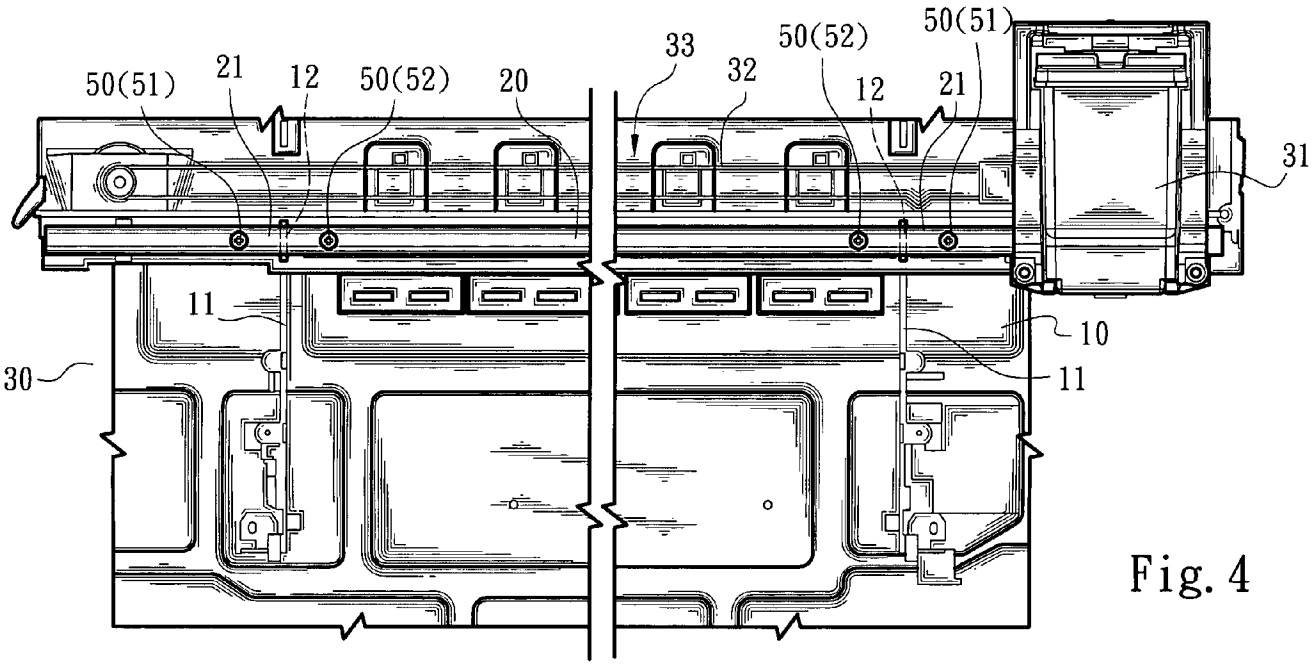
FIG. 4 is a plane view of a first embodiment of the present invention, showing that the carriage rod is secured to the frame body by means of the first and second retainers, which are arranged on two sides of the support section of the frame body.
Figure 5:
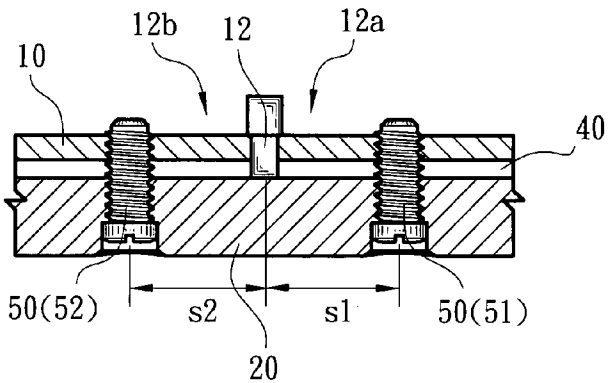
FIG. 5 is a sectional view of a part of FIG. 4.

Please refer to FIGS. 4 and 5. The fixing structure for print head carriage rod of the present invention includes a frame body 10 and a carriage rod 20 assembled therewith. The frame body 10 is disposed in a printing machine 30. According to a preferred embodiment of the present invention, an inkjet printer is taken as an example of the printing machine 30, which has a print head and an ink cartridge carriage 31. In this embodiment, the frame body 10 has sidewalls 11 and support sections 12 formed on the sidewalls 11 for supporting two ends 21 of the carriage rod 20 and spacing the carriage rod 20 from the frame body 10 by a distance 40. The print head and the ink cartridge carriage 31 are supported on the carriage rod 20. The ink cartridge carriage 31 can be driven via a belt 32 to reciprocally travel along the carriage rod 20 to execute printing operation on a printing section 33.

Referring to FIGS. 4 and 5, the fixing structure further includes retainers 50 disposed on the carriage rod 20 for securing the carriage rod 20 to the frame body 10. The retainers 50 can be rivets, screws or the like. In the preferred embodiment, each retainer 50 includes a first retainer 51 and a second retainer 52. The first and second retainers 51, 52 are respectively positioned on two sides of the support section 12 of the sidewall 11. FIG. 5 shows a right side of FIG. 4, in which the two sides of the support section 12 are respectively defined as a left side 12*b* and a right side 12*a*. The first retainer 51 is arranged on the right side 12*a* of the support section 12, while the second retainer 52 is arranged on the left side 12*b* of the support section 12. A distance s1 between the first retainer 51 and the support section 12 is equal to a distance s2 between the second retainer 52 and the support section 12. The first and second retainers 51, 52 and the support section 12 together prevent the carriage rod 20 from being flexed so as to avoid deterioration of the printing quality.

Figure 1:
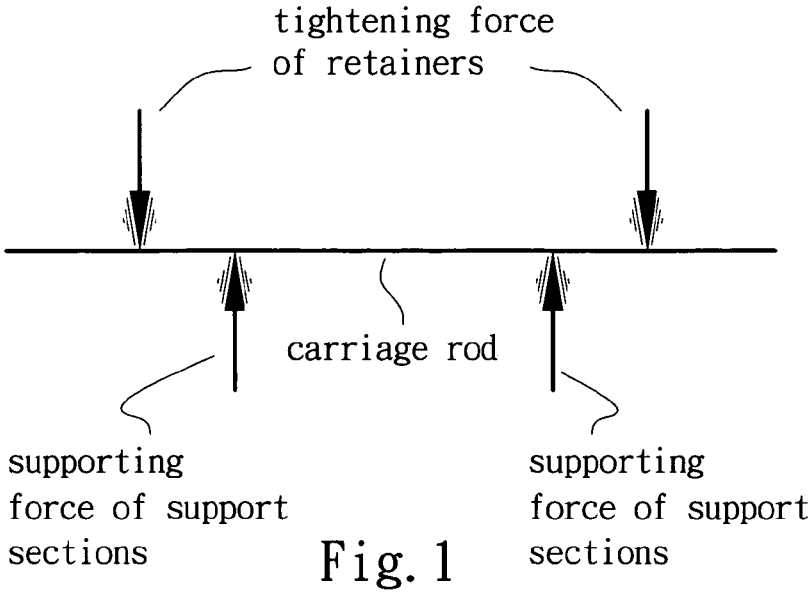
Fig. 1 PRIOR ART
FIG. 1 is a force diagram of a conventional carriage rod, which is tightened to a frame body by means of retainers and cooperative sidewalls of the frame body.
Figure 2:
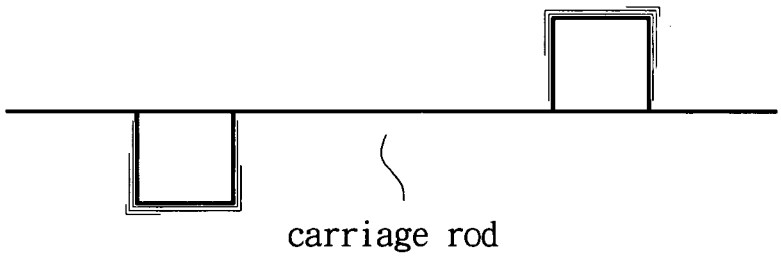
Fig. 2 PRIOR ART
FIG. 2 is a shear diagram of the conventional carriage rod, which is tightened to the frame body by means of the retainers and cooperative sidewalls of the frame body.
Figure 3:
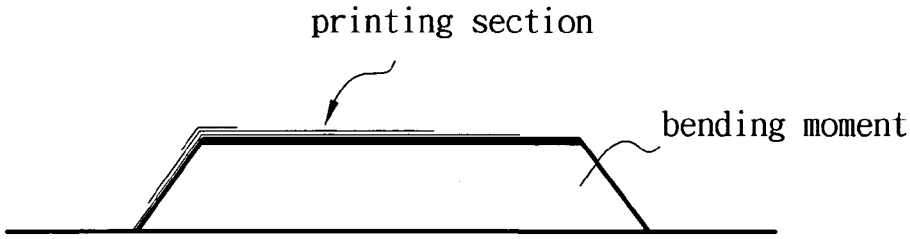
Fig. 3 PRIOR ART
FIG. 3 is a bending moment diagram of the conventional carriage rod, which is tightened to the frame body by means of the retainers and cooperative sidewalls of the frame body, showing the flexure of a section of the carriage rod on a printing section.
Figure 6:
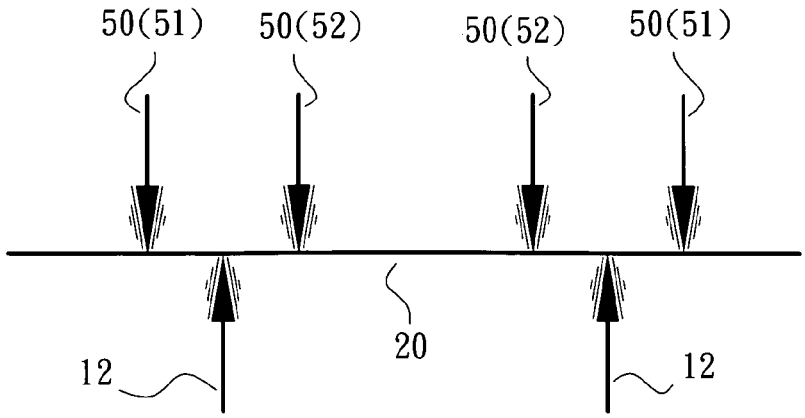
FIG. 6 is a force diagram of the carriage rod of the present invention, which is tightened to the frame body by means of the first and second retainers in cooperation with the support sections of the sidewalls of the frame body.
Figure 7:
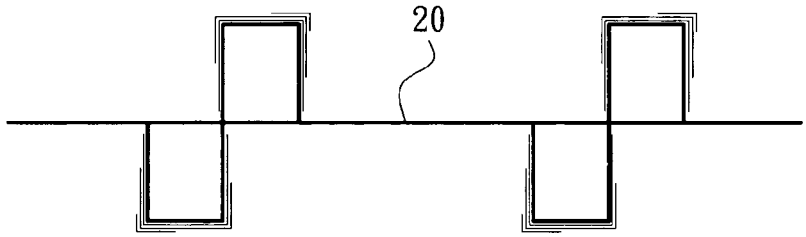
FIG. 7 is a shear diagram of the carriage rod of the present invention, which is tightened to the frame body by means of the first and second retainers in cooperation with the support sections of the sidewalls of the frame body.
Figure 8:
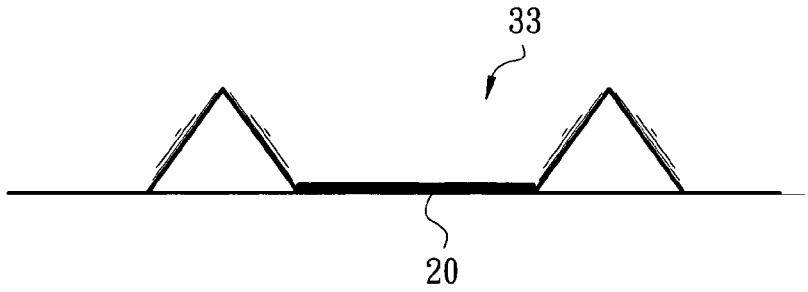
FIG. 8 is a bending moment diagram of the carriage rod of the present invention, which is tightened to the frame body by means of the first and second retainers in cooperation with the support sections of the sidewalls of the frame body, showing that the section of the carriage rod on the printing section is not flexed.

FIGS. 6, 7 and 8 respectively are a force diagram, a shear diagram and a bending moment diagram of the carriage rod 20 tightened with the first and second retainers 51, 52 and supported by the support sections 12. It can be seen by comparing FIG. 8 with FIG. 3 that the bending moment applied to a section of the carriage rod 20 on the printing section 33 is minimized. That is, according to the preferred embodiment of the present invention, the two ends 21 of the carriage rod 20 are tightened with the first and second retainers 51, 52 in cooperation with the support sections 12 instead of directly secured to the frame body by means of retainers. In this case, the flexure of the section of the carriage rod 20 on the printing section 33 is minimized. As shown in FIG. 8, the bending moment applied to the section of the carriage rod 20 on the printing section 33 is zero. This means the section of the carriage rod 20 on the printing section 33 will not be flexed nor deformed.

The fixing method for the print head carriage rod of the present invention includes steps of:

(a) disposing a first retainer 51 at each of the two ends 21 of the carriage rod 20, the first retainer 51 being arranged on a left side or a right side of the support section 12 of the sidewall, with reference to FIG. 5, the first retainer 51 being arranged on the right side 12*a* of the support section 12; and (b) disposing a second retainer 52 at each of the two ends 21 of the carriage rod 20, the second retainer 52 being arranged on a right side or a left side of the support section 12 of the sidewall opposite to the first retainer 51, with reference to FIG. 5, the second retainer 52 being arranged on the left side 12*b* of the support section 12.

The first and second retainers 51, 52 are respectively arranged on two sides of the support section 12. The distance s1 between the first retainer 51 and the support section 12 is equal to the distance s2 between the second retainer 52 and the support section 12.

Figure 9:
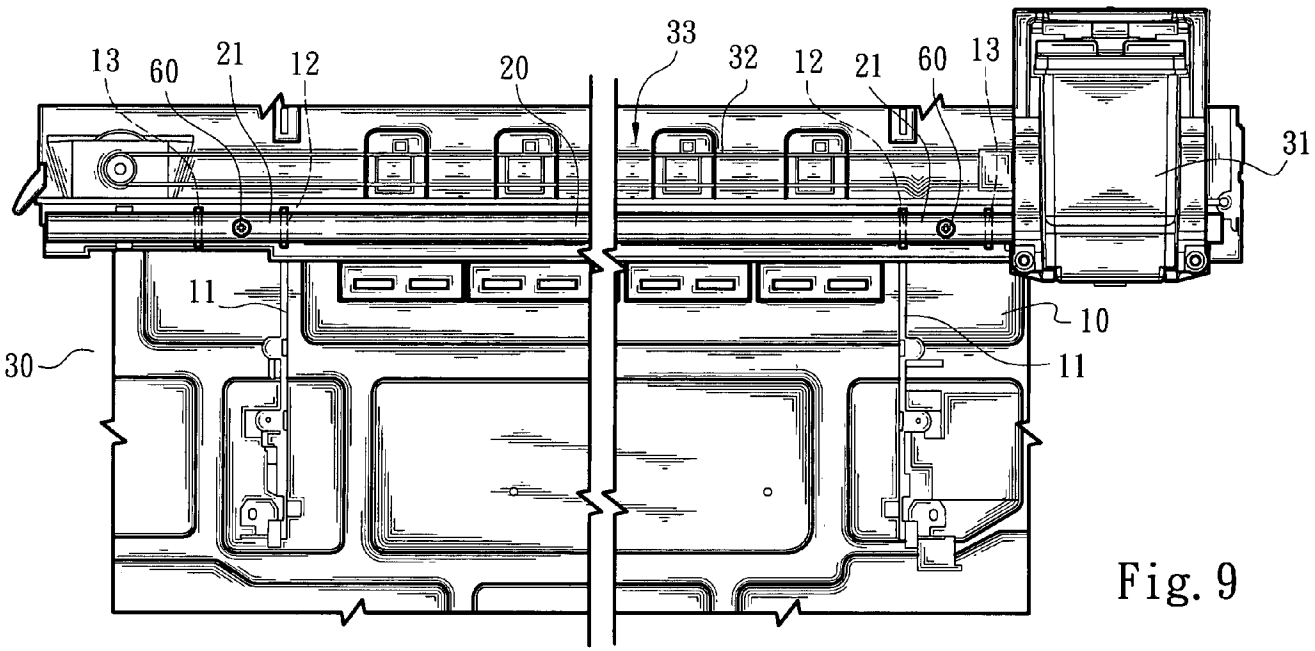
FIG. 9 is a plane view of a second embodiment of the present invention, showing that two support sections of the frame body are positioned on two sides of the retainer.
Figure 10:
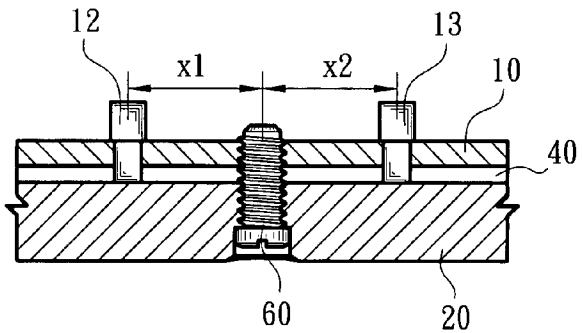
FIG. 10 is a sectional view of a part of FIG. 9.

FIGS. 9 and 10 show a second embodiment of the present invention. In this embodiment, two ends 21 of the carriage rod 20 are secured to the frame body 10 by means of two retainers 60. The frame body 10 is provided with two pairs of support sections 12, 13 for supporting the two ends 21 of the carriage rod 20 respectively. Each pair of support sections 12, 13 is positioned on two sides of the retainer 60 for supporting the carriage rod 20. FIG. 10 shows aright side of FIG. 9. The support section 12 is positioned on a left side of the retainer 60, while the support section 13 is positioned on a right side of the retainer 60. A distance x1 between the support section 12 and the retainer 60 is equal to a distance x2 between the support section 13 and the retainer 60.

According to the above arrangement, the fixing structure for the print head carriage rod and the fixing method for the print head carriage rod of the present invention have the following advantages:

1. In comparison with the conventional fixing structure, the retainers 50, 60, the carriage rod 20 and the support sections 12, 13 of the frame body are specifically structurally designed and deployed to minimize the possible flexure of the section of the carriage rod 20 on the printing section 33. In contrast, in the conventional fixing structure, two ends of the carriage rod are directly secured to the frame body by means of retainers. This will lead to flexure of the carriage rod. Also, the conventional fixing structure is more complicated than the present invention.
2. According to the arrangement of the retainers 50, 60, the carriage rod 20 and the support sections 12, 13 of the present invention, it is unnecessary to form any slot nor dispose any cantilever structure on the frame body. In this case, the structural strength of the frame body for fixing the carriage rod 20 will not be affected. Also, the vibration of the carriage rod 20 caused by reciprocal travel of the ink cartridge carriage along the carriage rod 20 in printing operation can be minimized. Moreover, the carriage rod 20 is prevented from being displaced or damaged due to collision caused by negligence during transfer, delivery or maintenance.

The above embodiments are only used to illustrate the present invention, not intended to limit the scope thereof. Many modifications of the above embodiments can be made without departing from the spirit of the present invention.

What is claimed is:

1. A fixing structure for print head carriage rod, comprising a frame body and a carriage rod assembled therewith, the frame body being disposed in a printing machine having a printing section, the frame body having two support sections, each support section protruding from the frame body and resting on the carriage rod for supporting each of two ends of the carriage rod, the fixing structure further comprising two first retainers and two second retainers for securing the carriage rod to the frame body, wherein each support section is arranged between one of the first retainers and one of the second retainers and keeps equidistance from the one of the first retainers and the one of the second retainers, the two second retainers are arranged between the two support sections, such that a bending moment applied to a section of the carriage rod on the printing section between the two second retainers is zero.

2. The fixing structure for print head carriage rod as claimed in claim 1, wherein the carriage rod is spaced from the frame body.

3. The fixing structure for print head carriage rod as claimed in claim 1, wherein a print head and an ink cartridge carriage are supported on the carriage rod to reciprocally travel along the carriage rod.

4. The fixing structure for print head carriage rod as claimed in claim 1, wherein the frame body has two sidewalls on which the support sections are formed.

5. The fixing structure for print head carriage rod as claimed in claim 1, wherein the first and second retainers are rivets.

6. The fixing structure for print head carriage rod as claimed in claim 1, wherein the first and second retainers are screws.

7. A fixing structure for print head carriage rod, comprising a frame body and a carriage rod assembled therewith, the carriage rod having two ends which are secured to the frame body by means of two retainers respectively, the frame body being disposed in a printing machine having a printing section, the frame body having two pairs of support sections protruding from the frame body and resting on the carriage rod for supporting the two ends of the carriage rod respectively, wherein each pair of support sections comprising a support section (12) and a support section (13), each retainer is arranged between the support section (12) and the support section (13) and keeps equidistance from the support section (12) and the support section (13), the two support sections (12) are arranged between the two retainers, such that a bending moment applied to a section of the carriage rod on the printing section between the two support sections (12) is zero.

8. The fixing structure for print head carriage rod as claimed in claim 7, wherein the carriage rod is spaced from the frame body.

9. The fixing structure for print head carriage rod as claimed in claim 7, wherein a print head and an ink cartridge carriage are supported on the carriage rod to reciprocally travel along the carriage rod.

10. The fixing structure for print head carriage rod as claimed in claim 7, wherein the retainer is a rivet.

11. The fixing structure for print head carriage rod as claimed in claim 7, wherein the retainer is a screw.

12. A fixing method for print head carriage rod, comprising steps of:

(a) disposing two first retainers at two ends of a carriage rod; and (b) disposing two second retainers at the two ends of the carriage rod, the first and second retainers being used to secure the carriage rod to a frame body, wherein each support section protruding from the frame body and resting on the carriage rod is arranged between one of the first retainers and one of the second retainers and keeps equidistance from the one of the first retainers and the one of the second retainers, the two second retainers are arranged between the two support sections, such that a bending moment applied to a section of the carriage rod on the printing section between the two second retainers is zero.

13. The fixing method for print head carriage rod as claimed in claim 12, wherein the frame body has two support sections for supporting the two ends of the carriage rod, the first and second retainers being positioned on two sides of the support sections.

* * * * *